United States Patent [19]

Periers

[11] 4,111,733

[45] Sep. 5, 1978

[54] METHOD AND APPARATUS FOR CONTINUOUS MANUFACTURE OF UNDULATING OR CORRUGATED MATERIAL

[75] Inventor: Gilbert Periers, Courtrai, Belgium

[73] Assignee: S.p.r.L. Limatex, Belgium

[21] Appl. No.: 823,018

[22] Filed: Aug. 8, 1977

Related U.S. Application Data

[63] Continuation of Ser. No. 598,404, Jul. 23, 1975, abandoned.

[51] Int. Cl.[2] ..... B65H 45/10; B65H 45/20; D06J 1/02

[52] U.S. Cl. ..... 156/204; 156/205; 156/227; 156/474; 198/577; 198/604; 198/626; 198/817; 223/28; 270/61 F

[58] Field of Search ..... 156/72, 183, 204, 205, 156/208, 210, 227, 459, 462, 474, 470; 223/28, 34; 226/172; 270/61 F, 68 R, 68 A, 94; 198/626, 817, 577, 595, 604, 605

[56] References Cited

U.S. PATENT DOCUMENTS

| | | | |
|---|---|---|---|
| 2,220,589 | 11/1940 | Unger | 156/72 |
| 2,670,026 | 2/1954 | Ungar | 156/474 |
| 2,682,216 | 6/1954 | Shields | 198/604 |
| 2,902,397 | 9/1959 | St. John | 156/205 |
| 3,012,923 | 12/1961 | Slayter | 156/474 |
| 3,127,293 | 3/1964 | Trenteseaux | 156/474 |
| 3,616,135 | 10/1971 | Tesainer | 156/210 |
| 3,665,863 | 5/1972 | Patin | 198/817 |
| 3,679,533 | 7/1972 | Fukuda et al. | 156/210 |

*Primary Examiner*—Michael G. Wityshyn
*Attorney, Agent, or Firm*—Robert E. Burns; Emmanuel J. Lobato; Bruce L. Adams

[57] ABSTRACT

A method for the continuous manufacture of an undulating or corrugated longitudinal material in which a strip is projected longitudinally in the form of transverse folds between two longitudinal walls defining a passage or corridor having a height exceeding the thickness of the strip, a longitudinal displacement of said walls being caused in the direction of projection of the strip at a speed lower than the linear projection speed and decreasing in the direction of movement, in such a manner as to cause the packing or bunching of the folds inside the passage or corridor along the length of the material.

2 Claims, 4 Drawing Figures

METHOD AND APPARATUS FOR CONTINUOUS MANUFACTURE OF UNDULATING OR CORRUGATED MATERIAL

This is a continuation of application Ser. No. 598,404, filed July 23, 1975, now abandoned.

BACKGROUND OF THE INVENTION

This invention relates to a method for the continuous manufacture of an undulating longitudinal material, and also to a device enabling this method to be carried out.

More precisely, the invention relates to the manufacture of such a material by transverse folding of a flexible longitudinal band such as a fibrous sheet, or a cloth composed of several fibrous sheets, or again a band of paper, fabric, non-wovens, or a sheet of glass, or again a strip of foam of plastics material etc.

At the present time use is made, for such a treatment, of an installation comprising basically a passage or corridor bounded by two rigid plane walls parallel to the general plane of the strip of material to be shaped, between which rollers situated close to one end of the passage project the strip to be treated, while retarding rollers situated close to the other end of the passage cause the bunching up of the strip inside this passage in the form of transverse folds.

Such an installation and such a procedure possess a certain number of considerable disadvantages.

A first disadvantage lies in the fact that it is not possible to treat in this manner strips or bands of rough-surfaced material, or strips coated with an adhesive or a binding agent, since such strips do not slide correctly along the walls of the passage, while they have a strong tendency to obstruct completely. The field of application of this known method is therefore limited, on the one hand by the nature of the materials which can be treated and, on the other hand, by the nature of the treatments between which the folding treatment is interposed.

In particular, as a result of the impossibility of adding a binding agent to the strip before the strip is folded, it is only possible to ensure that the folded material maintains its shape upon leaving the device by gluing it onto at least one support, which considerably limits the range of possible applications. Other disadvantages of this natural tendency of the material to re-adopt its original shape are also found, these disadvantages being due in this case to the fact that there exists, at a number of points in the known folding devices, possibilities of escape of the material, the consequence of which is a complete jamming of the device: this can occur notably at each of the ends of the passage, where there is a gap, oven though very small, between the walls of the passage and the projection rollers or retarding rollers for the strip; it is also the case between the various trains of retarding rollers.

SUMMARY OF THE INVENTION

Since the folding treatment according to this invention is applied by means of moving walls such as endless belts, situated opposite to each other and entraining the strip by friction during folding, it may be applied to strips of any material, and in particular to rough strips, and this regardless of the treatment to which they have previously been subjected: for example, it is possible according to this invention to treat strips to which adhesive has been applied, abrasive strips and the like etc.

Moreover whereas, in the case of known devices, it is necessary when forming tight folds to utilise a large number of successive trains of retarding rolls, by reason of the fact that it is not possible to impose upon the strip reductions in speed which are too drastic without risk of tight packing of the apparatus which could lead to its jamming and bursting, the use in accordance with this invention of sets of successive endless belts, preferably constructed in the form of narrow straps disposed in staggered array in order to enable the successive endless belts to interlace with one another, makes it possible to impose upon the strip undergoing treatment considerably more drastic retardations without risk of cramming and jamming, and thus to produce denser folding by means of a member of endless belts considerably less than the number of retarding rollers which would be indispensable if the known device were to be used.

As a result of this absence of any risk of cramming or jamming due to the continuous control of the movement of the strip, it is also possible by suitably selecting or varying the distances between the belts constituting the successive sets or their speeds, to control the folding action completely and to produce materials of very different thicknesses, having folds generally perpendicular to the general plane of the material or having flat folds.

The totality of these possibilities offered by the invention makes it possible to produce, by folding, materials which hitherto were manufactured by means of much more complicated and costly methods.

These possibilities are still further increased, according to the forms of embodiment of the device corresponding to its particular applications, by the addition downstream of the endless belts of means for opening the folds of the material towards one of its sides for the purpose, for instance, of introducing a binding agent or, upstream thereof, by the addition of means for subjecting the strip to an alternating transverse deformation in its own plane. As a result of the latter possibility it is possible, when treating in the form of flat or inclined folds a cloth of oriented fibres, to produce a material having crossed fibres, which has numerous applications notably in the field of filter manufacture.

Thus, the scope of application of the invention is especially wide since, depending upon the particular modes of carrying the invention out and upon the different materials treated, it is possible to deal with materials for filtration, with felts in general, with materials for upholstery, mattress-making, furniture making, clothing, thermal or acoustic insulation products in general, reinforcing products for panels known as "sandwich" panels, carpets in general of the knop or furry type (respectively by fixing a support to one of the faces of the material or by fixing such a support to each of its faces and then slicing or splitting the material along its thickness), crinkled or corrugated papers or cardboards etc.

The continuous method of manufacture of a corrugated longitudinal material according to this invention, by the transverse folding of a flexible longitudinal strip or band, is characterised in that the strip is projected longitudinally in the form of transverse folds between two longitudinal walls defining a passage or corridor having a height exceeding the thickness of the strip, by causing a longitudinal displacement of said walls in the direction of projection of the strip at a speed lower than the linear speed of projection and decreasing in the direction of movement, in such a manner as to cause a packing or bunching of the folds inside the passage along the length of the material.

The device according to the invention, itself, is characterised in that it comprises:

at least two successive sets of two longitudinal endless belts comprising opposing portions defining between them a longitudinal passage or corridor having a height exceeding the thickness of the strip, means for imparting to said endless belts a translatory movement relative to themselves in such a way that their facing portions move in the same direction;

means, disposed close to the upstream end of the passage, for projecting the strip longitudinally inside said passage in the direction of movement, at a linear speed exceeding the speed of movement of the endless belts in such a way as to form transverse folds, the speed of an endless belt of the downstream set being less than that of the belt of the set upstream of it, in such a way as to cause a packing or bunching of the folds along the length of the material.

DESCRIPTION OF PREFERRED EMBODIMENT

Figure 1:
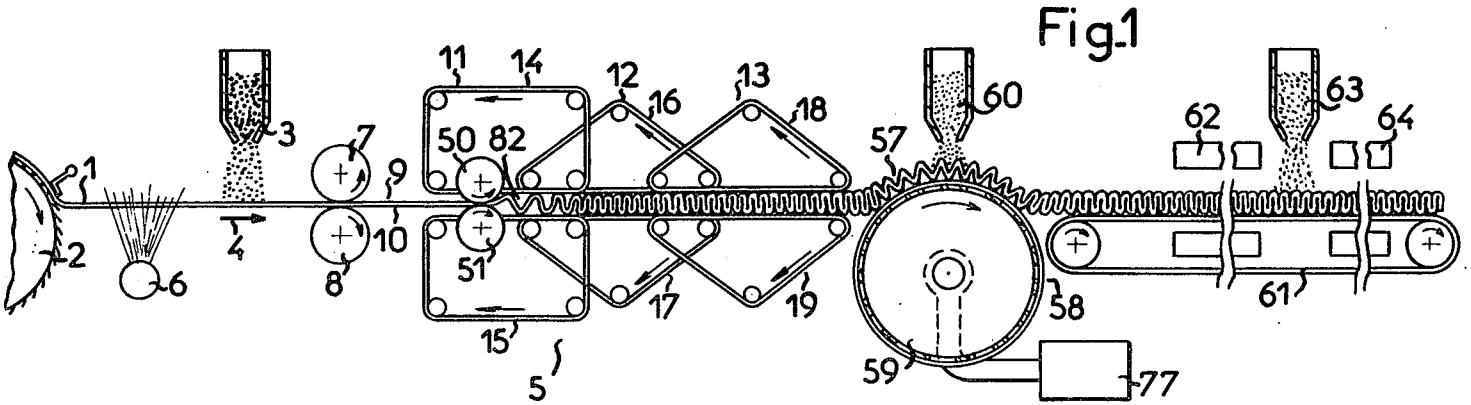
FIG. 1 shows diagrammatically the manufacture according to this invention of a folded material without a support, having folds substantially perpendicular to its general plane.

FIG. 1 illustrates, for example, the case of the production of an acoustically and thermally insulating material starting from a longitudinal strip which, as already noted, constitutes a flexible band, being constituted, for example, of a sheet or cloth 1 of oriented fibres issuing from a card 2 and moving continuously longitudinally, this movement being indicated diagrammatically by an arrow 4.

Before passing through the folding station proper 5, this sheet is first subjected, at 3, to a treatment intended for stiffening the fibres and in itself known; this may for example consist of the pulverising of a solid binding agent, preceded by the passage of the sheet in front of steam atomising jets 6, or again the atomisation of a liquid binding agent, the folding device according to this invention permitting the treating of wetted materials. In either case, the sheet may pass one or more sets of two transverse rotating rolls 7 and 8 disposed opposite to each other, respectively in contact with the upper face 9 and the lower face 10 of the sheet 1, these rolls may serve only for the driving and flattening of the sheet, but they may also be heated to a temperature such that it causes a complete fixing of the fibres, or again a simple temporary pre-fixing adapted to be completed or destroyed by appropriate treatments applied after the folding operation. In the case of the treatment of a sheet possessing a low tearing strength, these rolls must be rotationally driven by appropriate means so as to ensure the simultaneous driving of the sheet in the desired direction of movement 4.

It is of course possible for these preliminary treatments to vary depending upon the material constituting the strip or bands to be treated; in particular, there is no need for them to be used in the case of the treatment of a strip of plastic foam or paper, in which cases they may be left out or, where the material to be treated is excessively flexible, they may be replaced by the application of a dressing.

Figure 2:
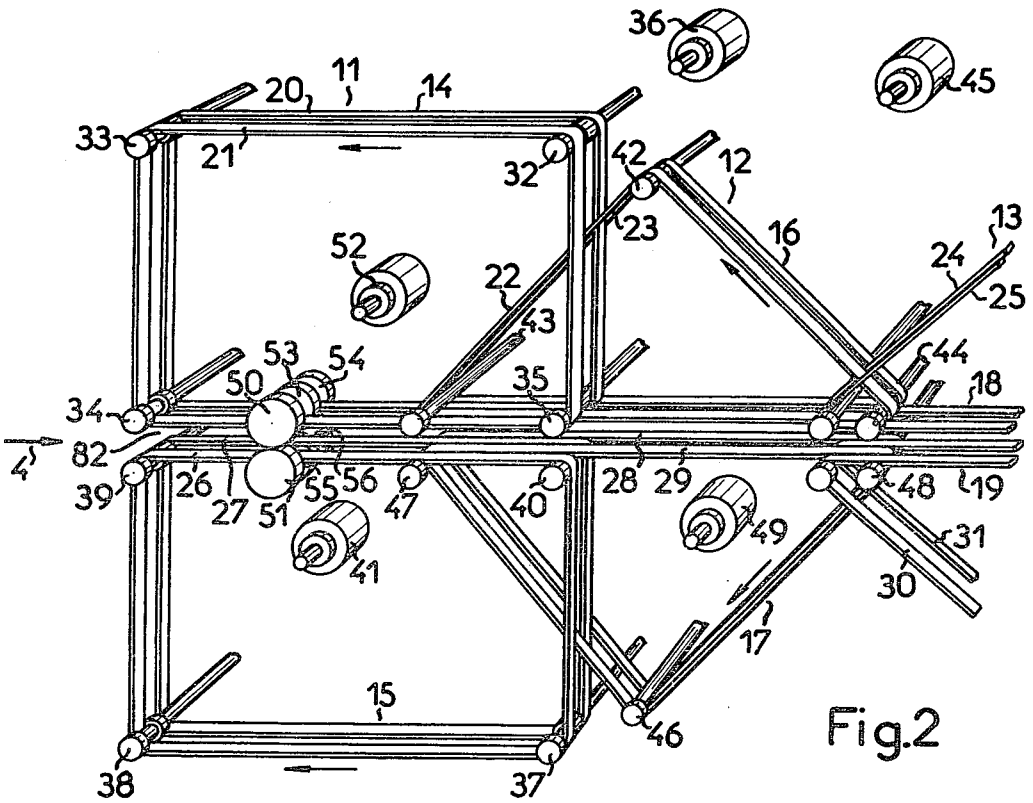
FIG. 2 shows a perspective view illustrating diagrammatically the construction of the folding station proper.

Following this, the strip constituted here of the card sheet or cloth 1, either dry or wet, is subjected to the folding treatment proper by passing through the folding station according to this invention 5, which is described more particularly with reference to FIG. 2.

According to the invention, the corrugated material is produced by the longitudinal projection of the strip in the form of transverse folds between two longitudinal walls provided by belts and defining a corridor or passage having a depth exceeding the thickness of the strip, a longitudinal movement in the direction of projection of the strip at a speed less than the linear speed of projection and decreasing in the direction of movement being imparted to said walls, in such a manner as to cause the packing or bunching of the folds inside the passage along the length of the material, while leaving the passage or corridor continuous, as shown.

In practice, this continuous passage or corridor 82 is defined by at least two successive sets 11 and 12 of endless belts facing one another, respectively 14–15 and 16–17, followed in the present case by a third set 13 of two facing endless belts 18 and 19, the successive endless belts 14, 16, 18 defining one wall opposite to the upper face 9 of the sheet 1, the other three belts 15, 17, 19 defining a wall opposite to its lower face 10.

One preferred form of embodiment of the device according to this invention is aimed at the preventing of any interruption in the guidance of the strip through the continuous passage during folding, since such interruptions are a source of possible jamming of the material. Accordingly, each belt is constituted by the juxtaposition of a plurality of longitudinal straps spaced transversely, the straps which correspond to the successive belts being disposed in staggered array and meshing into one another in such a manner as to ensure the continuity of the passage.

Thus, the upper belt 14 of the first set 11 has been shown in the form of two juxtaposed endless straps 20 and 21, spaced apart transversely by a distance at least equal to their own width in such a manner as to permit the insertion between them of a similar strap 22 constituting, together with a second strap 23, the upper endless belt 16 of the second set 12.

Thus, each endless belt 14 to 19 is here constituted of two endless straps, respectively 20 and 21, 26–27, 22–23, 28–29, 24–25, 31–30, the breaking down of a belt into two parts in the form of two straps being the minimum to arrive at the result desired, this breaking down being effected preferably into a larger number of straps.

The straps constituting a single belt travel of course around the same rolls, around which they are driven at an equal speed: the two straps 20 and 21 constituting the belt 14 are, for example, rotationally driven about four rolls 32–35, the first of these rolls being connected to a motor-variable speed unit 36 of any known type, while in a similar manner one roll 37 of the rolls 37–40 which guide the straps 26 and 27 constituting the lower belt 15 of the same set 11, is connected to a motor-speed variation unit 41. The same is true for one of the rolls 42 to 44 for guiding the belt 16, connected to a motor-speed variation unit 45, for one of the rolls 46 to 48 for guiding the belt 17, connected to a motor-speed variation unit 49, and for one of the guiding rolls for each of the endless belts constituting the succeeding sets.

According to the invention, close to the upstream end of the passage 82, the device comprises means for longitudinally projecting the strip into the inside of the continuous passage in the direction of movement 4, which is the same as the direction of movement of the walls of this passage.

These means are constituted here of two transverse rolls 50 and 51, disposed opposite to each other, on either side of the sheet 1 and in contact respectively with the upper face 9 and the lower face 10 of this sheet. These two rolls are rotationally driven by a motor-speed variation unit 52 in such a manner as to ensure the driving of the sheet.

FIG. 2 illustrates a preferred form of embodiment of the device according to which, in order to prevent any risk of jamming, the rolls 50 and 51 act upon the sheet between the constituent belts of the first set 11. In order that it may be possible to impart to them a sufficient peripheral speed without their angular rotation speed being excessive, these rolls have a diameter such that their axis of rotation is situated outside the passage 82, and are equipped at their periphery with annular grooves, respectively 53, 54 and 55, 56, permitting the passage of the straps, respectively 20, 21 and 26, 27 constituting the two belts 14 and 15 of the first set 11.

In fact, according to the invention, the speed of projection of the sheet 1 inside the continuous passage 82 should be higher than the speed of movement of the belts used as walls of this passage, so that the sheet projected in the form of folds by the rollers 50 and 51 retains these folds inside the passage. The speed of movement of the belts of the second set 12 should again be less than that of the first set 11, in order to cause the packing or bunching of these folds along the length of the material. With regard to the speed of displacement of the belts of the third set 13 and of any further sets there may be, it also may be less than that of the second set 12 and continue decreasing, in which case it accentuates this packing of the folds, but it may also be equal, in which case it ensures the transporting of the folded material while holding it perfectly in the state to which it is brought by the second set 12.

Packing of the folds in the direction of the thickness of the material may itself be obtained if the passage 82 is given a converging form relative to the direction of movement 4. Such a convergence may be produced either by convergence of the two belts of certain sets, or by step changes, the facing portion of the successive belts being parallel to each other but closer and closer together.

It should be noted that in the new apparatus, this convergence can be much more accentuated than in the case of the known devices, where rolls are used for this purpose, due to the absence of any risk of escape and of jamming: thus it is possible according to the invention to obtain particularly intense packing in thickness, whereby the packing in the direction of the length may also be accentuated, for the same reasons that the material is perfectly held during its folding.

In the case, illustrated in FIG. 1, where it is desired to obtain a material in which the folds are substantially perpendicular to its general plane, the speeds of displacement of the two endless belts of a single set should be equal. However, as will be described below, it is also possible to produce, according to the invention, materials having flattened folds, by imparting to the belts constituting one of the walls of the passage 82 a speed greater or less than that of the belts constituting the other wall.

At the exit from the folding station 5, the folded material 57 obtained should be subjected to a treatment intended for fixing the folds together.

In the example illustrated in FIG. 1, according to which the material is not intended to receive a support on its faces but is to remain as it is, this treatment should be carried out by gluing the folds together, over a portion of their height or over the entirety of this height.

According to the preferred form of embodiment of the method according to this invention illustrated in FIG. 1, a treatment for fixing together the folds in depth is applied by causing them to open towards one of the faces of the material, for example towards its upper face 9.

The means for opening the folds are constituted here of a transverse rotating roller 58 in contact with the lower face 10 of the material. They also comprise means for applying the face 10 of the material against a portion of the periphery of this roll 58 in such a way as to communicate to this face 10 a concavity corresponding to a convexity of the upper face 9.

To achieve this, the cylindrical periphery of the roll 58 may be furnished with a rough facing, the nature of which should be determined according to the nature of the material treated. It is also possible to construct the roll 58 in the form of a hollow cylinder, the internal cavity 59 of which is connected to any known suction means 77, and the periphery of which is permeable so as to permit the application by, suction, of the lower face 10 of the material onto the roll.

It should be noted that it is important that the roll 58 should take over the material from the moment of its exit from the passage 20, in order to prevent any escape of material.

The in-depth fixing treatment for the folds applied at this stage may be of varying types. The treatment may be one intended for ensuring the positive setting of a binding applied at 3, but it may also involve the depositing of a new binding agent at the bottom of the folds, that is to say in the immediate proximity to the lower face of the material, which is the case illustrated at 60 in FIG. 1. In the case where a strip or band of synthetic fibres or plastics foam is treated, it is also possible to apply at this position heating intended for fixing the folds together at the level of the lower face of the material.

When it leaves the roll 58, there is no longer any risk of the material becoming unfolded and it may be subjected to the remainder of the treatment while simply resting upon an endless bolt 61. This treatment may consist, for example, of passing through a heated tunnel 62, intended for ensuring the setting of the binding agent deposited at 60, whereby the upper face of the material may subsequently receive, at 63, a new application of binding agent, followed by a new passage through a heating tunnel 64.

Figure 3:
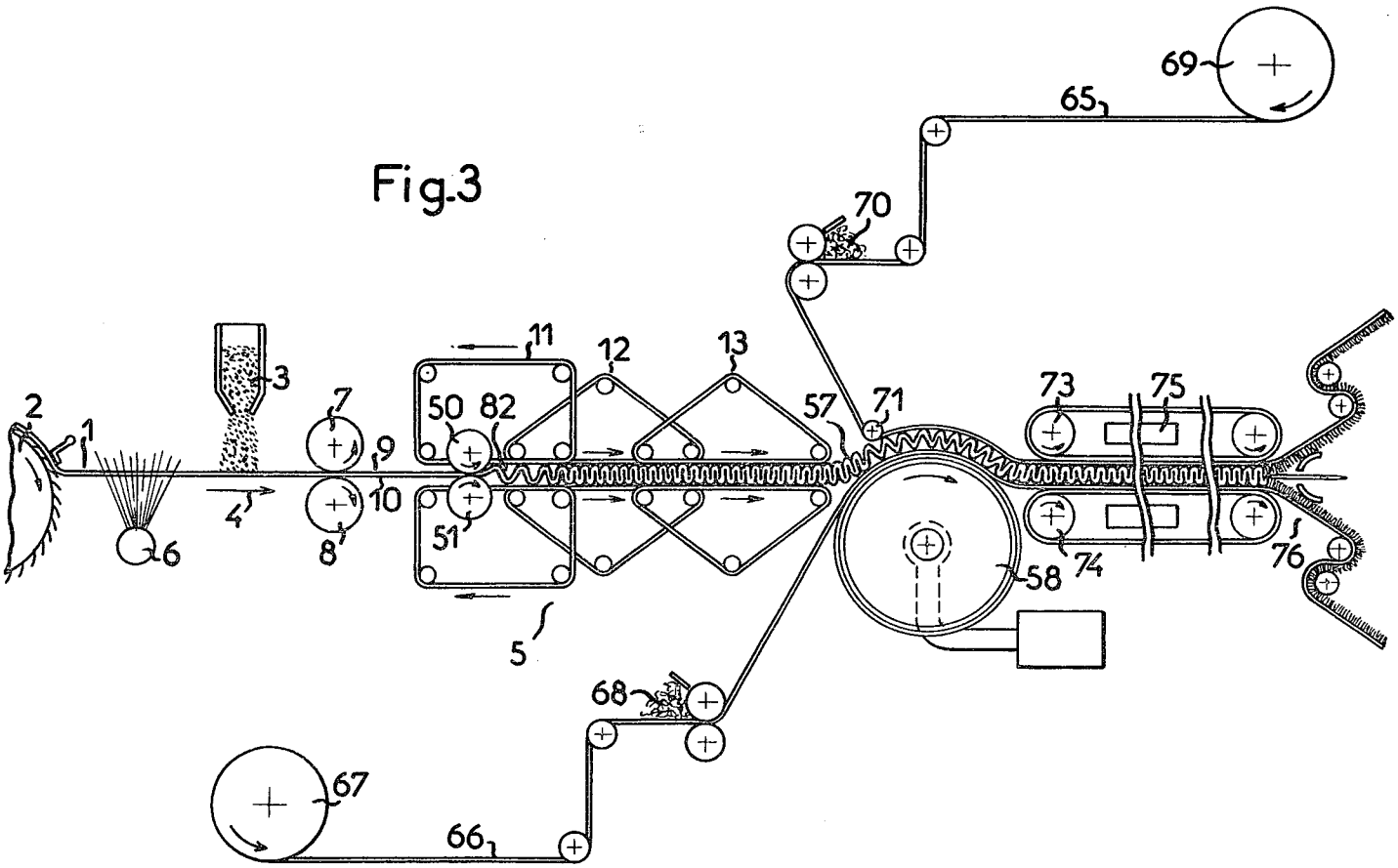
FIG. 3 illustrates diagrammatically the production of a folded material having folds substantially perpendicular to its general plane and reinforced by a support fixed to each of its two faces.

FIG. 3 illustrates a second example of the production of a folded material, the folds of which are perpendicular to its general plane, this material being in this case subjected to the application of a support onto each of its faces before being split along its thickness; this may for example be the case of the manufacture of a synthetic fur or a carpet, for example starting from a card sheet 1 and two textile supports 65 and 66.

Whatever the nature of the flexible strip treated, this strip may be subjected, until it leaves the folding device proper 5, to the same treatments as in the preceding case, by means of the same devices, illustrated in FIG. 3 where the same references are use in FIG. 1.

Nevertheless, when it leaves the folding passage 82, the folded material 57 is no longer caught up directly by the roll 58, since a support 66 is inserted between its lower face and the periphery of the cylinder.

This support 66 is, for example, unreeled at 67 and guided by any known means, its face intended for coming into contact with the folded material undergoing, between the unreeling station 67 and the roll 58, an application of a coating of an adhesive or a binding agent at 68.

With regard to the second support 65, this is unreeled at 69, undergoes coating with an adhesive or a binding agent at 70, before being applied to the upper face of the material 57 by a roll 71.

At its exit from the roll 58, the whole assembly is taken over by two endless belts 73 and 74, each applied against one of the supports, which belts drive the assembly through a heating tunnel 75 intended for causing the setting of the binding agents applied at 68 and 70. Finally, the completed product is split along its thickness by any known device 76.

In view of the effectiveness of the device in regard to the packing of the folds both in the direction of the length of the material and also in the direction of its thickness, and in view of the facility for intensifying at will this packing by adjusting the distance between the belts of the different successive sets and by increasing the number of these sets, it is thus possible to obtain, by starting from a sheet or cloth of fibres of appropriate type and denier, a folded material of shallow depth and great density of folding which, when split, possesses the appearance of a velvet of the "short flocked" type. This procedure is much less tricky and difficult than the electrostatic flocking procedures hitherto known.

It is of course possible, depending upon the types of manufacture, to equip the folded material 57 with only a lower support 66, whereby the assembly may in addition be subjected to a fixing treatment for the folds in depth analagous to that which is applied at 60 in the example illustrated in FIG. 1.

Depending upon the particular case, the folded material faced with one or more supports may then be subjected to any known treatment, notably at the supports.

Figure 4:
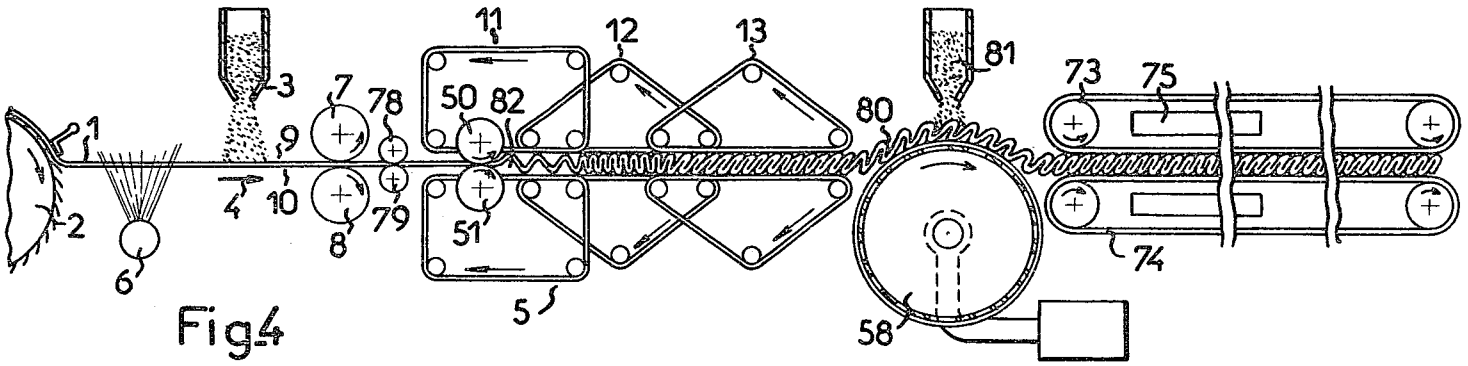
FIG. 4 illustrates diagrammatically the production of a folded material having flat and crossed folds, without a support.

Finally, FIG. 4 illustrates the particular case of the manufacture of a material having flat folds and crossed fibres, intended for example for filtration. Such a material is preferably manufactured from a sheet or cloth having oriented fibres.

In the example illustrated in FIG. 4, this sheet 1, issuing from a card 2, receives at 3, after optional steaming at 6, a binding agent, the setting of which is caused by the heating rolls 7 and 8 bearing respectively onto the upper face 9 and onto the lower face 10 of the sheet, (these treatments and the corresponding devices have been described above).

Downstream of the rolls 7 and 8 in relation to the direction of movement 4 of the sheet, this sheet is subjected to the action of a device which subjects it to an alternating transverse deformation in its own plane, imparting to the fibres a zig-zag movement while keeping them parallel to one another.

In the present case, this device is constituted of at least two transverse revolving rolls 78 and 79, disposed opposite to each other upstream of the projection means 51, and in contact respectively with the upper face 9 and the lower face 10 of the sheet 1. These rolls undergo a reciprocating movement along their axes, so that they transversely entrain the fibres alternately in one direction and then the other.

The strip deformed in this way is then subjected to the action of the folding device according to the invention 5. In order to produce flattened folds, a speed is imparted to each upper belt 14, 16, 18 which exceeds the speed of the corresponding lower belt, respectively 15, 17, 19, whereby the speed of each belt may, in addition and as in the preceding cases, be less than that of the belt preceding it and higher than that of the belt following it, in order to ensure the packing of the folds in the direction of the length of the material. It is moreover possible, as in the preceding cases, to impart a convergence to the passage 82 defined by the belts, in order to ensure the packing of the folds in the direction of the thickness.

At the exit from the folding device 5, as in the example illustrated in FIG. 1, the material having flat folds 80 is picked up by a roll 58, which causes these folds to open towards the upper face to permit the introduction between the folds of a binding agent intended for fixing them together; this application may be carried out by means of an atomiser 81, whereby the belts 73 and 74 subsequently entrain the product inside a heating tunnel 75 which causes the binding agent to set.

By judiciously selecting the dimension of the folds and of the zig-zags imparted before folding, by the rollers 78 and 79, it is thus possible to produce a crossed-fibres material which is particularly effective in the field of filtration. This material may, if necessary, be placed between two supports, as already described with reference to FIG. 3.

The invention has been described with reference to three particular applications, intended for illustrating its various possibilities, but it is not limited to these three examples. It does in fact permit flexible strips of very different types to be treated, either before or after other treatments capable of leading to the manufacture of very varied products, and it may thus be subjected to numerous variants without thereby departing from its concept.

In the case of fusible fibres in particular, it is possible to effect the various fixing operations described without the addition of a binding agent, but instead by carrying out a localised fusion of the fibres, for example by "singeing" using flame nozzles. Depending upon the particular case, it is thus possible to ensure a fixing of the folds at one face of a folded material not furnished with a support, or at both its faces, or again the fixing of a support such as a fabric onto one or both faces of such a material.

What is claimed is:

1. A method of manufacturing folded strip material, comprising the steps of:

establishing a continuous passage receptive of a flexible strip to be folded and having a height greater than a thickness of the strip, by providing a plurality of mutually successive sets of endless belts, each set having two belts which have belt portions vertically spaced from one another to define the passage between them for folding the strip between them, each belt comprising a plurality of transversely spaced longitudinal belt straps, the straps of adjacent sets of belts being disposed in staggered array and interpenetrating one another to ensure continuity of the passage;

moving the flexible strip to be folded, at a predetermined speed, in a direction longitudinal of the strip, into and through the continuous passage;

displacing belt strap portions along the continuous passage, in said direction, at a lesser speed than said predetermined speed, to bend the flexible strip to be folded into transverse strip folds during passage of said strip between the belts, by belt strap displacing means comprising rolls which have circumferential grooves receptive of the belt straps in said staggered array; and decreasing said lesser speed of displacing the belt strap portions through each said successive set of belts, in said direction, to pack the strip folds in the continuous passage and thereby to produce densely folded strip material.

2. Apparatus for manufacturing folded strip material, comprising;

a plurality of mutually successive sets of endless belts, each set having two belts which have belt portions vertically spaced from one another to define between them a continuous passage receptive of a flexible strip to be folded between them, the passage having a height greater than a thickness of the strip, and each belt comprising a plurality of transversely spaced longitudinal belt straps, the straps of adjacent sets of belts being disposed in staggered array and interpenetrating one another to ensure continuity of the passage;

strip-feeding means for moving the flexible strip to be folded, at a predetermined speed, in a direction longitudinal of the strip, into the continuous passage;

belt-strap displacing means, comprising rolls which have circumferential annular grooves receptive of the belt straps in said staggered array, for displacing belt strap portions along the continuous passage, in said direction, at a lesser speed than said predetermined speed, to bend the flexible strip to be folded into transverse strip folds during passage of said strip between the belts; and means for decreasing said lesser speed of displacing the belt strap portions through each said successive set of belts, in said direction, to pack the strip folds, in the continuous passage, and thereby to produce densely folded strip material.

* * * * *